US005358654A

United States Patent [19]

Torenbeek et al.

[11] Patent Number: 5,358,654

[45] Date of Patent: Oct. 25, 1994

[54] STABLE POURABLE AQUEOUS BLEACHING COMPOSITIONS COMPRISING SOLID ORGANIC PEROXY ACIDS AND AT LEAST TWO POLYMERS

[75] Inventors: Reinder Torenbeek, Terwolde; Jan J. H. Ploumen, Roermond, both of Netherlands

[73] Assignee: Akzo Nobel N.V., Arnhem, Netherlands

[21] Appl. No.: 845,291

[22] Filed: Mar. 3, 1992

Related U.S. Application Data

[63] Continuation-in-part of Ser. No. 639,304, Jan. 2, 1991, Pat. No. 5,126,066, which is a continuation of Ser. No. 368,507, Jun. 20, 1989, abandoned, and a continuation-in-part of Ser. No. 562,778, Aug. 3, 1990.

[30] Foreign Application Priority Data

Jun. 22, 1988 [EP] European Pat. Off. ..... 88109925.3
Aug. 8, 1989 [EP] European Pat. Off. ..... 89202052.0

[51] Int. Cl.[5] ..... C11D 3/37; C11D 3/39; C11D 3/395

[52] U.S. Cl. ..... 252/95; 252/102; 252/174.17; 252/174.18; 252/174.23; 252/174.24; 252/186.26; 252/186.42

[58] Field of Search ..... 252/95, 102, 104, 174.17, 252/174.18, 174.23, 174.24, 186.26, 186.42

[56] References Cited

U.S. PATENT DOCUMENTS

| | | | |
|---|---|---|---|
| 3,507,800 | 4/1970 | Leveskis | 252/186 |
| 3,989,638 | 11/1976 | Bradley et al. | 252/186 |
| 3,996,152 | 12/1976 | Edwards et al. | 252/186 |
| 4,017,412 | 4/1977 | Bradley | 252/186 |
| 4,100,495 | 7/1978 | Hutchins et al. | 252/99 |
| 4,232,141 | 11/1980 | Koyanagi et al. | 526/344.2 |
| 4,264,466 | 4/1991 | Carleton et al. | 252/99 |
| 4,547,308 | 10/1985 | Torenbeek | 252/186.26 |
| 4,634,551 | 1/1987 | Burns et al. | 252/102 |
| 4,642,198 | 2/1987 | Humphreys et al. | 252/94 |
| 4,681,592 | 7/1987 | Hardy et al. | 8/111 |
| 4,686,063 | 8/1987 | Burns | 252/102 |
| 4,758,369 | 7/1988 | Dryoff et al. | 252/94 |
| 4,790,949 | 12/1988 | Dankowski et al. | 252/95 |
| 4,842,765 | 6/1989 | Satomi | 252/186.26 |
| 4,879,057 | 11/1989 | Dankowski et al. | 252/99 |
| 4,909,953 | 3/1990 | Sadlowski et al. | 252/99 |
| 4,992,194 | 2/1991 | Liberati et al. | 252/99 |

FOREIGN PATENT DOCUMENTS

| | | |
|---|---|---|
| 0160342 | 11/1985 | European Pat. Off. . |
| 0167375 | 1/1986 | European Pat. Off. . |
| 0176124 | 4/1986 | European Pat. Off. . |
| 0200163 | 11/1986 | European Pat. Off. . |
| 0201958 | 11/1986 | European Pat. Off. . |
| 0240481 | 10/1987 | European Pat. Off. . |
| 0254331 | 1/1988 | European Pat. Off. . |
| 267175 | 5/1988 | European Pat. Off. . |
| 0283791 | 9/1988 | European Pat. Off. . |
| 0283792 | 9/1988 | European Pat. Off. . |
| 0347988 | 12/1989 | European Pat. Off. . |
| 1387167 | 3/1975 | United Kingdom . |
| 153804 | 12/1978 | United Kingdom . |

OTHER PUBLICATIONS

"Xanthon Gum/Keltrol/Kelzan/A Natural Biopolysaccharide for Scientific Water Control", Printed by Kelco, a division of Merck & Co., Inc., 1976, 2nd Ed. pp. 8,9 and 28.

Chemical Abstracts, vol. 106 (69183m), 1987.

*Primary Examiner*—Paul Lieberman
*Assistant Examiner*—E. M. Higgins
*Attorney, Agent, or Firm*—Ralph J. Mancini; Louis A. Morris

[57] ABSTRACT

This disclosure relates to pourable bleaching compositions comprising a solid substantially water-insoluble organic peroxy acid stably suspended in an aqueous medium containing at least two polymers wherein the first polymer is selected from polysaccharides having at least 60% of the units in the polysaccharide backbone being linked together by a 1,4-β-oxy linkage and the second polymer is selected from the group consisting of polyvinyl alcohol, one or more cellulose derivatives and mixtures thereof. The bleaching composition also may contain an electrolyte and/or a safety booster. The preferred organic peroxy acid is 1,12-di peroxydodecanedioic acid.

13 Claims, 1 Drawing Sheet

STABLE POURABLE AQUEOUS BLEACHING COMPOSITIONS COMPRISING SOLID ORGANIC PEROXY ACIDS AND AT LEAST TWO POLYMERS

This application is a continuation-in-part of U.S. patent application Ser. No. 07/639,304 filed on Jan. 2, 1991 now U.S. Pat. No. 5,126,066 of Reinder Torenbeek and Jan Joseph Hubert Ploumen for, "Stable, Pourable Aqueous Bleaching Compositions Comprising Solid Organic Peroxy Acids and at Least Two Polymers," which is a continuation of U.S. patent application Ser. No. 07/368,507 filed Jun. 20, 1989 , now abandoned of Reinder Torenbeek and Jan Joseph Hubert Ploumen for, "Stable, Pourable Aqueous Bleaching Compositions Comprising Solid Organic Peroxy Acids and at Least Two Polymers, " now abandoned, and a continuation-in-part of U.S. patent application Ser. No. 07/562,778 filed on Aug. 3, 1990 of Jan Joseph Hubert Ploumen for, "Aqueous Peroxide Compositions With Improved Safety Profitable."

The invention relates to pourable bleaching compositions comprising a solid, substantially water-insoluble organic peroxy acid stably suspended in an aqueous medium. In particular, the present invention relates to bleaching compositions of the above type characterized in that the aqueous medium also comprises at least two polymers wherein the first polymer is one or more polysaccharides wherein at least 60% of the units in the polysaccharide backbone are linked together by a 1,4-$\beta$-oxy linkage and the second polymer is selected from the group consisting of polyvinyl alcohol, cellulose derivatives and mixtures thereof. The bleaching composition may additionally be comprised of an electrolyte, such as $Na_2SO_4$.

The invention also relates to an aqueous peroxide composition with improved safety profile, said composition comprised of a solid substantially water-insoluble organic peroxy acid stably suspended in an aqueous medium as described above characterized in that the aqueous medium also comprises an effective amount of triethylene glycol and/or polyethylene glycol.

The bleaching compositions of the current invention may be used alone or in combination with other bleaches. Additionally, the current bleaching compositions may be included as part of detergent, bleaching, cleaning and/or disinfecting formulations.

Bleaching compositions comprising a solid, substantially water-insoluble organic peroxy acid stably suspended in an aqueous medium are generally known from British Patent Specification 1 535 804. This patent specification discloses fabric bleaching compositions having a viscosity from 200 to 100,000 cp. and a non-alkaline pH, the compositions comprising an aqueous carrier, 1–40 weight percent particulate, organic, substantially water-insoluble peroxygen compound and a thickening agent. Specifically mentioned thickening agents are inorganic thickeners, such as clays, and organic thickeners, such as water-soluble gums, mucilaginous materials, starches, polyacrylamides and carboxylpolymethylene. In particular, British Patent Specification 1 535 804 discloses the use of cellulose derivatives such as carboxymethyl celluloses, hydroxypropyl cellulose and methyl hydroxybutyl cellulose, hydrolyzed proteins such as hydrolyzed keratins, glutens, polyvinyl alcohol and polyvinylpyrrolidone, and natural gums such as gum arabic, carrageen and various agars.

Further, European Patent Application No. 283 792 discloses storagestable, pourable aqueous bleach suspensions having a pH value in the range of 1 to 6 and containing (a) particulate, water-insoluble peroxy-carboxylic acid (e.g., diperoxydodecanedioic acid), (b) xanthan gum or agars, (c) hydratable neutral salt (e.g., $Na_2SO_4$), (d) optionally an acid for pH regulation (e.g., $H_2SO_4$) (e) aqueous liquid.

It is known to be advantageous to use liquid bleaching compositions rather than solid bleaching compositions in automatic clothes washers and dryers. Among those advantages is that with liquid bleaching compositions there is no need for cost-increasing shaping steps, such as granulating and drying. Additionally, liquid bleaching compositions are more easily dispersed in wash liquor or in an automatic clothes dryer so the fabrics are more rapidly and evenly bleached. Uneven bleaching can damage fabric as a result of localized high concentrations of bleaching agent.

As disclosed in European Patent Application 176 124, the bleaching compositions of GB 1 535 804, at least as far as they are pourable, have the disadvantage that they are not physically stable. As shown by composition 7 in EP 176 124, after prolonged storage, pourable bleaching compositions of GB 1 535 804 undergo phase separation, producing a thick bottom layer which is difficult to disperse or homogenize. Consequently, the aforementioned advantage of even fabric distribution may be partly eliminated.

Further it should be mentioned that GB 1 535 804 does not disclose or suggest the use of more than one thickening agent in a single fabric bleaching composition. Indeed, it is clear from Example III of GB 1 535 804) that the cellulose derivatives tested as thickening agents were tested in individual, separate bleach compositions. Additionally, the bleach composition of Example III of GB 1 535 804 is a "thick, semi-gelatinous composition" (see page 11, lines 32–35 of GB 1 535 804) rather than a pourable composition of the present invention.

It should be noted that U.S. Pat. No. 4,232,141 (NL 707 916) discloses, inter alia, grinding coarser particles of a polymerization initiator in an aqueous medium containing a dispersing agent to form an aqueous dispersion of the polymerization initiator. The polymerization initiator may be, inter alia, a peroxy dicarbonate or a benzoyl peroxide. Claim 9 claims that the dispersing agent may be polyvinyl alcohol, cellulose ether, gelatine or a mixture thereof. However, only single dispersing agents (either polyvinyl alcohol or methyl cellulose) are used in the working examples of U.S. Pat. No. 4,232,141 to form polymerization initiator dispersions. These dispersions were then added to vinyl chloride polymerization suspensions to form polyvinyl chloride. Some vinyl chloride polymerization suspensions of the examples of U.S. Pat. No. 4,232,141 contain a mixture of polyvinyl alcohol and methyl cellulose. However, as demonstrated herein below, an aqueous suspension acceptable under bleaching conditions (pourability, physical stability and chemical stability) and prepared as suggested by U.S. Pat. No. 4,232,141, is not physically stable.

It is also a continuing problem to provide aqueous peroxide suspensions with an improved safety profile. For example, boric acid has a negative effect on the chemical stability of peroxide suspensions. Additionally, boric acid is undesirable since aqueous suspensions have an inherent maximum solid content and the presence of boric acid reduces the amount of solid peroxy acid which may be placed in the suspension.

It has been surprisingly found that an aqueous peroxide composition with an improved safety profile may be formed comprising a solid substantially water-insoluble organic peroxy acid stably suspended in an aqueous medium characterized in that the aqueous medium also comprises an effective amount of triethylene glycol and/or polyethylene glycol.

Further, peroxy acids, and suspensions of such acids, are highly reactive and thus have a strong propensity for combustion and/or explosion. This raises transportation problems in that, for safety reasons, the amount of peroxy acid transported in a bulk container must be limited. It has been surprisingly found that the addition of polyethylene glycol to suspensions of peroxy acids reduces the likelihood of combustion and/or explosion of such suspensions.

It should be particularly noted that GB 1 387 167 discloses a solid particulate bleaching agent comprised of a peroxy substance (such as a peroxy acid) which has been substantially surrounded by a water-impermeable material having a melting point between 30° and 95° C. and further surrounded by a water-soluble inorganic hydrate salt. Such double-coated particles may also be sprayed with polyethylene glycol. The specification of GB 1 387 167 suggests the polyethylene glycol spraying to make the salt coating more resistant to abrasion, to dedust the particles and to control the rate of particle solution. GB 1 387 167 mentions desensitizing the peroxide only in the context of the water-impermeable material.

The bleaching compositions of the current application are defined as being physically stable when the compositions undergo insignificant, and preferably no, phase separation during a reasonable storage time.

The solid, substantially water-insoluble organic peroxy acids which may be used in the bleaching compositions of the current invention are generally known in the art. As non-limiting examples, the solid organic peroxy acids disclosed in European Patent Applications 160 342, 176 124 and 267 175, U.S. Pat. Nos. 4,681,592 and 4,634,551 and GB Patent Specification 1 535 804 may be used and are all herein incorporated by reference. The most preferred organic peroxy acids which may be used in the compositions of the current invention are (1) diperoxy acids, such as 1,12-diperoxydodecanedioic acid ("DPDA"), diperazelaic acid and 1,13 diperoxytridecanedioic acid, (2) peroxy acids which have a polar amide link in the hydrocarbon chain, such as N-decanoyl-6-amino-peroxyhexanoic acid, N-dodecanoyl-6-aminoperoxyhexanoic acid, 4-nonylamino-4-oxoperoxybutyric acid and 6-nonylamino-6-oxoperoxyhexanoic acid, and (3) alkyl sulphonyl peroxycarboxylic acids, such as heptyl sulphonyl perpropionic acid, octyl sulphonyl perpropionic acid, nonyl sulphonyl perpropionic acid and decylsulphonyl perpropionic acid.

Methods for preparing such preferred organic peroxy acids are known in the art and in particular from the above cited references. Optionally, the solid organic peroxy acid may be coated with a water-impermeable material, such as the fatty acids 1 lauric acid, myristric acid and mixtures thereof, as known from European Patent Application 254 331.

The amount of organic peroxy acid in the current bleaching formulations depends on criteria such as the active oxygen ("A.O.") content of the peroxy acid and the intended use of the bleaching composition. The preferred amount of peroxy acid is that which will provide effective washing, bleaching, cleaning and/or disinfecting in a diluted liquor. Generally, though non-limiting, the current bleaching compositions have a peroxy acid concentration which will provide an A.O. content of between about 1 and about 200 ppm, and preferably between about 2 and about 100 ppm in a typical diluted liquor for use in washing, bleaching, cleaning and/or disinfecting.

The first polymer comprises one or more polysaccharides wherein at least 60% of the saccharide units in the polysaccharide backbone are linked together by a 1,4-$\beta$-oxy linkage. More particularly, from the publication, "Applications of Novel Biogums," Clare, K., *Chemspec USA* '88 *Symposium*, the structures of some gums are known. This article characterizes the structure of biogums by the units in the backbone and the units in the side chain. This publication also depicts the 1,4-$\beta$-oxy linkage in the structure of Rhamsan and Whelan gums, for example.

Accordingly, the present invention is directed to polysaccharides which have a particular backbone structure whereby at least 60% of the saccharide units in the backbone are linked by the 1,4-$\beta$-oxy linkage. It has been found that the desirable viscosity effects which lead to a physically stable suspension that is also pourable, directly result from the 1,4-$\beta$-oxy linkages in these polysaccharides.

As examples of such polysaccharides are mentioned natural gums such as xanthan gum, gum arabic, carrageen, agars obtained from seaweed, as well as other gums such as Alpha flo®, Rhamsan gum and Whelan gum.

The amount of polysaccharide in the current bleaching formulations is the amount which is effective to provide a physically and chemically stable, pourable aqueous formulation. Generally, the polysaccharide makes up about 0.1 to about 1 wt. % of the bleaching composition.

The second polymer is selected from the group consisting of polyvinyl alcohol, one or more cellulose derivatives and mixtures thereof. A group of cellulose derivatives particularly useful are cellulose ethers. Cellulose ethers are known from, for example, *Ullmann's Encyclopedia of Industrial Chemistry*, Fifth Edition, Vol. A5, pages 461–487. Of particular advantage for use in the current bleaching compositions are methyl cellulose, methyl hydroxypropyl cellulose methyl hydroxybutyl cellulose, hydroxyethyl cellulose and carboxymethyl cellulose. The amount of second polymer incorporated in the current bleaching formulations is the amount which will provide a physically and chemically stable, pourable aqueous bleaching composition. Generally, though non-limiting, the second polymer is present as about 0.02 to about 2 wt. % of the bleaching composition.

An electrolyte may also be present in the aqueous medium to help provide a useful, pourable bleaching composition. The electrolyte may result from the residual acid present in the peroxy acid as a result of the peroxidation reaction. The electrolyte may also be added deliberately to enhance the physical stability of the current suspensions and increase their safe handling (See European Patent Application 176 124). Examples of suitable electrolytes are $Na_2SO_4$, $K_2SO_4$, $MgSO_4$, $Al_2(SO_4)_3$, $NaNO_3$ and borate salts. The amount of electrolyte present depends, inter alia, on the peroxy acid and the polymers employed and on the intended use of the suspension. However, in general, though non-limiting, the electrolyte may be up to about 30 wt. % of the composition.

The additives used to prepare the aqueous peroxide compositions with improved safety profile according to the present invention may be further described as follows.

Polyethylene glycol (also referred to as polyoxyethylene, polyglycol or polyetherglycol), hereinafter sometimes referred to as PEG, is available in various numbered grades which reflect the approximate molecular weight of the polymer. PEG may also be classified by its degree of polymerization. A grade 200 PEG is equivalent to PEG-4 (PEG having 4 degrees of polymerization). A grade 600 PEG is equivalent to PEG-12. For the current invention, PEG-4, PEG-8, and PEG-12 are preferred ignition-safe additives with PEG-4 being the most preferred. PEG's may be purchased under the trademark "Carbowax". Triethylene glycol ("TEG") may also be employed in suspensions of the current invention, either alone or in combination with PEG.

Preferably, the safety of the aqueous peroxide compositions is improved to such an extent as to provide suspensions which are considered ignition-safe upon drying.

The amount of PEG necessary to provide suspensions which are ignition-safe upon drying depends on various criteria, such as the peroxy acid used, the active oxygen content of the peroxy acid and the concentration of the peroxy acid. As demonstrated by the examples which follow, aqueous suspensions of about 22 to 27 wt. % DPDA are rendered ignition-safe upon drying with the use of about 19 wt. % PEG-12, about 17 wt. % PEG-8 or about 14 wt. % PEG-4. Such suspensions also have substantially increased safety as suspensions, allowing for bulk storage and transportation of greater volumes of suspension and more concentrated suspensions. Aqueous suspensions of about 6 wt. % DPDA are rendered ignition-safe upon drying with the use of about 4 wt. % PEG-12 or 3 wt. % PEG-4.

The amount of TEG necessary to provide suspensions which are ignition-safe upon drying also depends on various criteria, such as the peroxy acid used, the active oxygen content of the peroxy acid and the peroxy acid concentration. As demonstrated by the examples which follow, aqueous suspensions of about 25 wt. % DPDA are rendered ignition-safe upon drying with about 10 wt. % TEG. Suspensions of about 6 wt. % DPDA are ignition-safe at about 2 wt. % TEG.

In general it may be recognized that in the preferred aqueous peroxide compositions according to the present invention, which are ignition safe upon drying, the weight percentage of the additive is at least about half the weight percentage of peroxy acid.

Optionally, the current bleaching compositions may also comprise anti-freezing agents, such as glycol.

The bleaching compositions of the current invention are further illustrated by the following non-limiting examples.

EXAMPLE 1

Comparative Example

Figure 1:
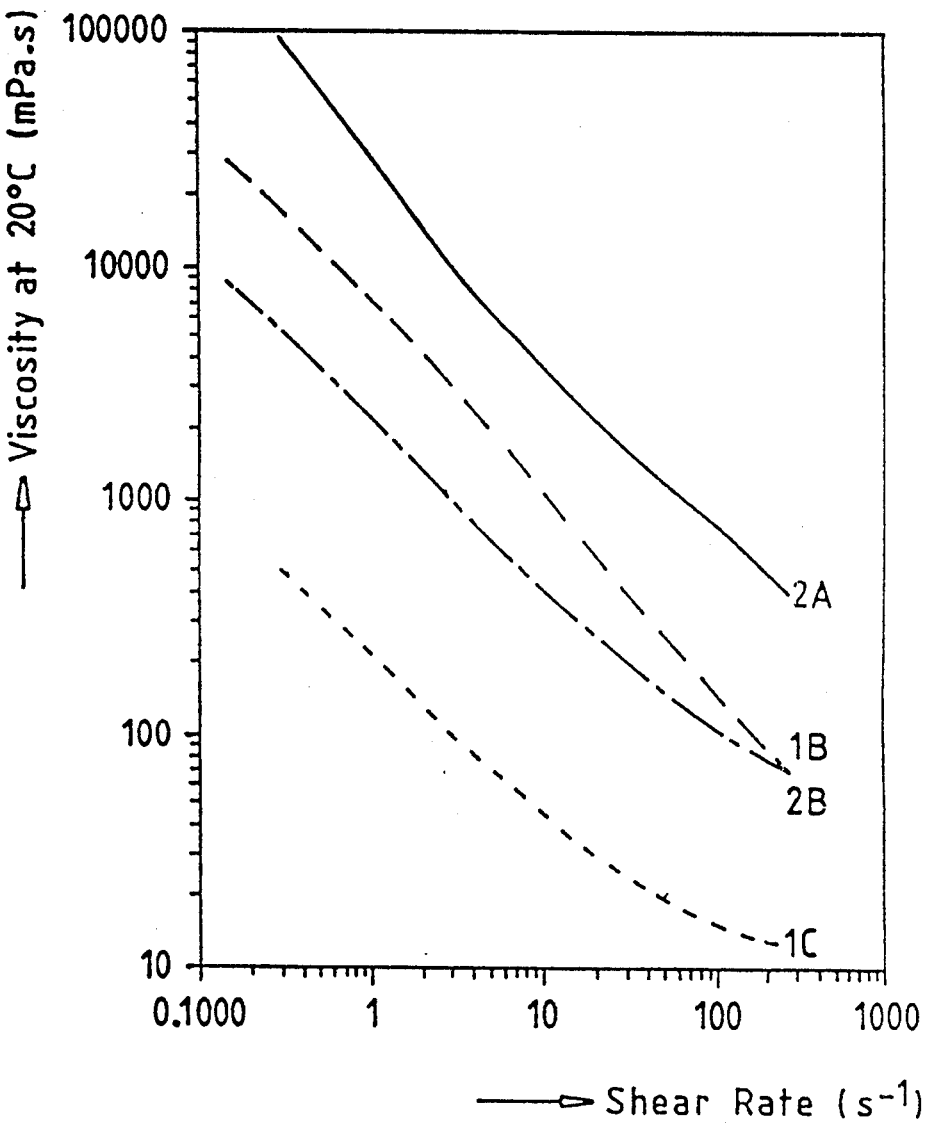
FIG. 1 exemplifies the calculated viscosity values plotted against shear rate of the composition of Examples 2.

This example illustrates the problems presented by aqueous organic peroxy acid suspensions which contain no polymer or which contain only one water-soluble polymer. Test suspensions of 500 grams were prepared by mixing 274 grams organic peroxy acid (1,12-diperoxydodecandioic acid ("DPDA") in wet filter cake form, having an active oxygen (A.O.) content of 5.47%) with a solution of 15 grams $Na_2SO_4$ and 1 gram test polymer (if present) based on active material in 210 grams water. This produced test suspensions having an active oxygen content of 3.0%. The viscosity of each test suspension was measured (Brookfield RV, 20 r.p.m.) and the physical stability (in terms of phase separation) was monitored during an 8 week 20° C. storage period. The results are contained in Table 1.

TABLE 1

| Test Suspension | Water-soluble Polymer | Viscosity (mPa · s) | Phase Separation |
|---|---|---|---|
| 1A | None | 2400 | None |
| 1B | Xanthan gum (Rhodigel 23 from Rhone Poulenc) | 1700 | Small amount |
| 1C | Hydroxyethyl cellulose (Natrosol 250 L from Hercules) | 50 | Large amount |

As shown in the results in Table 1, even though the addition of the water-soluble polymer hydroxyethyl cellulose substantially reduces the test suspension viscosity, making it conveniently pourable, the phase separation is unacceptable. The addition of xanthan gum alone to the test suspension reduces viscosity, but not enough to provide acceptable pourability. Also, Test Suspension 1B is not physically stable as indicated by the phase separation.

EXAMPLE 2

To be useful as bleaching compositions, the suspensions of the current invention must be chemically stable as well as pourable and physically stable. That is, the bleaching compositions of the current invention must retain their ability to bleach while they are being stored prior to use. The chemical stability of a peroxy acid is indicated by the retention of active oxygen (A.O.). However, active oxygen is affected by the presence of $H_2O_2$ as well as peroxy acid (such as DPDA). $H_2O_2$ is formed by the decay reactions of peroxy acids. Therefore, a more accurate indication of chemical stability after storage is the "residual peroxy acid", or in this case, "residual DPDA". "Residual DPDA" is the active oxygen content (A.O.) minus $H_2O_2$ formed by the decay of the peroxyacid. The $H_2O_2$ content was determined by extraction with a mixture of diethyl ether and water, separation of the water layer, addition of Ti(IV) reagent and spectrophotometric measurement of the yellow complex formed.

Two 500 gram test suspensions were independently prepared by mixing 274 grams DPDA filter cake (A.O.=5.47%) in about 200 grams of water. The first suspension was completed by adding 15 grams $Na_2SO_4$ and 0.25 gram Dequest® 2010 (a sequestering agent available from Monsanto). The second suspension was completed by adding 15 grams $Na_2SO_4$, 0.25 grams Dequest® 2010, 1 gram hydroxyethyl cellulose (Natrosol ®250 L) and 1 gram xanthan gum (Rhodigel ® 23). The initial active oxygen content and viscosity of each suspension were measured. Each suspension was divided in half. One half of each suspension was stored for 8 weeks at 20° C. and the other half stored for 8 weeks at 30° C. The chemical stability (active oxygen loss and residual DPDA), the rheology (viscosity) and the physical stability (phase separation) data are given in Table 2 below.

TABLE 2

| | Suspension Without Polymers (Suspension 2A) | Suspension With Xanthan Gum and Hydroxyethyl Cellulose (Suspension 2B) |
|---|---|---|
| Loss in Active Oxygen (8 weeks at 30 C.) | <1% | <1% |
| Residual DPDA | | |
| After 8 weeks at 20 C. | 99% | 98% |
| After 8 weeks at 30 C. | 96% | 95% |
| Phase Separation | | |
| After 8 weeks at 20 C. | none | none |
| After 8 weeks at 30 C. | none | none |
| Viscosity (Brookfield RV, 10 rpm) in mPa · s | | |
| Initially | 9500 | 650 |
| After 8 weeks at 20 C. | 9800 | 580 |

Surprisingly, the suspensions of the current invention were conveniently pourable as well as being chemically and physically stable over the 8 week test period.

In order to compare and predict the rheological behavior ("pourability") of known compositions and compositions of the current invention, a plot of viscosity vs. shear rate ("rheogram") was generated for Test Suspensions 1B and 1C of Example 1 and for the suspensions of Example 2. The shear stress was recorded versus the shear rate applied with a Haake Rotovisco RV 100 at 20°. The calculated viscosity values are plotted versus the shear rate in FIG. 1. Suspensions which follow the curve of Suspension 1B are not easily pourable as demonstrated by laboratory attempts to pour them without shaking the contents of the container. (Note that such lack of pourability was also indicated by the Brookfield viscosity measurement of Suspension 1B as reported at Table 1.) However, suspensions which follow the curve of Suspension 2B are pourable. Liquid detergents currently available in Western Europe (therefore having commercially acceptable pourability) follow the curve of Suspension 2B and are of lower viscosity than Suspension 1B. As discussed in Example 1, Suspension 1C is pourable but not physically stable.

Additionally, from plots of shear stress versus shear rate, the yield value of Suspension 2A was found to be about 200 Pa while that of Suspension 2B was found to be about 15 Pa. For suspensions of the current invention, yield values between about 5 and about 20 Pa provide the most desirable "pourability" behavior.

EXAMPLE 3

Comparative Example

A bleaching composition comprised of components suggested by the disclosure in U.S. Pat. No. 4,232,141 was prepared as a comparative example. A test suspension was prepared by mixing 326.1 grams DPDA wet filter cake (A.O.=5.22%) with 193.9 grams of an aqueous solution of 0.25 gram Dequest ® 2010, 1.0 gram PVA (Gohsenol ® KP-08, 75% hydrolyzed, available from Nippon Gohsei) and 1.0 gram hydroxyethyl cellulose (Natrosol ® 250 L available from Hercules). This produced a test suspension having an active oxygen content of 3.3%. Sodium sulfate was omitted from the composition since PVA precipitated from solution in the presence of $Na_2SO_4$ prior to the addition of DPDA. The viscosity of the test suspension was 89 mPa.s (Brookfield LVT, 30 r.p.m.). After 8 weeks storage at 20° C., 160 ml of water separated from the test suspension.

EXAMPLE 4

A bleaching composition was prepared in accordance with the composition of Example 3 modified by the addition of 1.0 gram xanthan gum to bring the suspension of this Example within the scope of the current invention. The viscosity of the test suspension was 938 mPa.s (Brookfield LTV, 30 r.p.m.). After 8 weeks storage at 20° C., only an insignificant 4 ml of water separated from the test suspension. The composition was conveniently pourable.

EXAMPLE 5

As disclosed in European Patent Application 254 331, organic peroxy acids may be prepared in such a manner that the resulting organic peroxy acid also comprises a water-impermeable material, such as fatty acid. The fatty acid may, among other things, increase the safe handling and use of organic peroxy acids.

Test suspensions using DPDA with lauric acid (a fatty acid) were prepared by mixing 206 grams DPDA coated with 1 lauric acid (wet filter cake, A.O.=6.07%), aqueous solutions containing varying amounts PVA or PVA and xanthan gum as set forth in Table 3 to form 500 gram aqueous suspensions. The lauric acid-coated DPDA was prepared substantially in accordance with the method of European Patent Application 254 331 by heating and stirring a suspension of DPDA at 50° C., adding 1 lauric acid in a weight ratio of 3:1 DPDA to lauric acid, stirring for 10 minutes, cooling and separating the DPDA and lauric acid combination from water on a filter.

Again, the viscosity of each test suspension was measured (Brookfield RV at 20 r.p.m., except Test Suspension 3D which was measured at Brookfield LV at 60 r.p.m.) and the physical stability was monitored during an 8 week period at 20° C. The data are reported in Table 3.

Test Suspension 3A does not contain a water-soluble polymer. It does not separate over the 8 week period, but it is also not conveniently pourable. Test Suspensions 3B, 3C and 3D contain the water-soluble polymer PVA (as suggested by U.S. Pat. No. 4,232,141). They are conveniently pourable but have unacceptable phase separation. Test Suspension 3E, containing both xanthan gum and PVA according to the present invention, shows no phase separation, is as chemically stable as Test Suspension 3A and is conveniently pourable. Thus, the current bleaching compositions are suitable for use with organic peroxy acids which also comprise a water-impermeable material.

TABLE 3

| Test Suspension | Water-soluble Polymer | Viscosity (mPa · s) | $H_2O$ Separation After 8 weeks |
|---|---|---|---|
| 3A | None | 7600 | 0 |
| 3B | 0.5 g PVA (Gohsenol ® KP-08) | 905 | 38 |

TABLE 3-continued

| Test Suspension | Water-soluble Polymer | Viscosity (mPa · s) | $H_2O$ Separation After 8 weeks |
|---|---|---|---|
| 3C | 1.0 g PVA (Gohsenol ® KP-08) | 421 | 42 |
| 3D | 2.0 g PVA (Gohsenol ® KP-08) | 43 | 139 |
| 3E | 1.0 g PVA (Gohsenol ® KP-08) and 1.0 g xanthan gum (Rhodigel ®) | 1360 | 0 |

EXAMPLE 6

For some purposes (such as bulk transportation), it is desirable to produce aqueous, pourable suspensions having a relatively high peroxy acid concentration and/or active oxygen content. It has been surprisingly found that the bleaching compositions of the current invention are capable of suspending a substantially larger amount of organic peroxy acid on a weight percent basis than known suspensions.

For example, currently known aqueous suspensions of the organic peroxy acid DPDA are capable of suspending a maximum of about 32 wt. % DPDA and have an active oxygen content of about 3.5%. In the case of aqueous suspensions of DPDA in combination with a water-impermeable material, such as a fatty acid (for example, lauric acid), the active oxygen content may be reduced to about 2.5%. Surprisingly, aqueous suspensions have been prepared using the polymer system of the current invention to produce bleaching compositions with substantially increased DPDA (with and without lauric acid) concentration and substantially increased active oxygen content. The details of these compositions are contained in Table 4.

TABLE 4

| | | Suspension of DPDA Particles | Suspension of DPDA-Lauric Acid Particles |
|---|---|---|---|
| 1. | Composition (wt. %) | | |
| | DPDA | 43.5 | — |
| | DPDA-Lauric Acid (3:1) | — | 40.7 |
| | Hydroxyethyl cellulose (Natrosol ® 250 L) | 0.3 | — |
| | Polyvinyl Alcohol (Gohsenol ® KP-08) | — | 0.4 |
| | Xanthan Gum (Rhodigel ®) | 0.1 | 0.2 |
| | Dequest 2010 | 0.05 | 0.05 |
| 2. | Initial A.O. content of DPDA (%) | 11.5 | 8.6 |
| 3. | Initial A.O. content of Suspension | 5.0 | 3.5 |
| 4. | Chemical Stability | | |
| | 8 weeks, 20 C. (Residual DPDA as % of Initial DPDA) | 96 | 98 |
| | 8 weeks, 30 C. (Residual DPDA as % of Initial DPDA) | 95 | 97 |
| 5. | Phase Stability | | |
| | 8 weeks, 30 C. | No Phase Separation | No Phase Separation |

EXAMPLE 7

Suspensions having relatively high peroxy acid concentrations (e.g., above about 20 wt. % for peroxyacids such as DPDA) are preferred for industrial purposes, such as bulk transportation and handling. However, relatively low peroxy acid concentrations (e.g., about 5–10 wt. % for peroxyacids such as DPDA for U.S. consumers) are desirable for household use. Therefore, it is preferable that the previously described pourable, storage-stable concentrated suspensions can be diluted to form pourable, storage-stable dilute suspensions.

As shown in Table 5, two suspensions having relatively high peroxy acid concentrations (27 wt. % ) were prepared. Suspension 5A is a comparative example containing peroxy acid and sodium sulfate. Suspension 5B is a two polymer formulation within the current invention. Comparative suspension 5A was used to prepare 500 ml dilute comparative suspension 5C. Suspension 5B was used to prepare 500 ml dilute suspension 5D according to the current invention. As reported in Table 5, dilute suspension 5D is physically and chemically stable over a 4 week period while suspension 5C separates after 3 weeks at 40° C. Chemical stability is reported in terms of "Residual DPDA". "Residual DPDA" was determined by the method described in Example 2, above.

TABLE 5

| Test Suspension* | | Water-Soluble Polymer(s) | Wt. % DPDA | Phase Stability (Separate Water Phase After 4 weeks, 40° C.) | Chemical Stability (Residual DPDA After 4 weeks, 40° C.) |
|---|---|---|---|---|---|
| 5A | — | None | 27 | Not Determined | Not Determined |
| 5B | — | 0.2 wt. % xanthan gum 0.2 wt. % hydroxyethyl cellulose | 27 | Not Determined | Not Determined |
| 5C | 3 | 0.5 wt. % xanthan gum | 6 | 50 ml | 90% |
| 5D | 3 | 0.05 wt. % xanthan gum 0.05 wt. % hydroxyethyl cellulose | 6 | 0 ml | 90% |

*All Test Suspensions contain 3 wt. % sodium sulfate. Test suspensions 5C and 5D contain 0.5 wt. % Dequest ® 2010 (a sequestering agent) and 3 wt. % acid.

EXAMPLE 8

This Example 8 demonstrates, inter alia, the effect of temperature on suspensions of the current invention. Temperature effects are particularly important in that industrial processing and transportation is likely to occur at lower temperatures (e.g., about 10° C. -30° C.) while consumer storage and usage is likely to occur at higher temperatures (e.g., about 20°–40° C.).

Test suspensions identical to those of Example 2 were prepared. Suspension 8A is identical to suspension 2A. Suspension 8B is identical to suspension 2B. Portions of the suspensions were stored for 8 weeks at 20° C., 30° C. and 40° C. then tested for chemical stability (residual DPDA), phase stability and rheological stability ("pourability"). Additionally, these characteristics were also monitored after 4 weeks for suspensions stored at 40° C. The results are provided in Table 6. It should be noted that "pourability" was determined by pouring (or attempting to pour) each suspension from a 500 ml container. Suspensions giving a streaming behavior similar to that of commercially available heavy duty detergents were "pourable".

TABLE 6

| | Suspension 8A (Without Polymers) | Suspension 8B (With Polymers) |
|---|---|---|
| Chemical Stability (Residual DPDA) | | |
| a. 8 weeks/20° C. | 99% | 98% |
| b. 8 weeks/30° C. | 96% | 95% |
| c. 4 weeks/40° C. | 93% | 92% |
| d. 8 weeks/40° C. | 84% | 79% |
| Phase Stability | | |
| a. 8 weeks/20° C. | No Phase Separation | No Phase Separation |
| b. 8 weeks/30° C. | No Phase Separation | No Phase Separation |
| c. 4 weeks/40° C. | No Phase Separation | No Phase Separation |
| d. 8 weeks/40° C. | No Phase Separation | No Phase Separation |
| Rheological Stability | | |
| a. 8 weeks/20° C. | Not Pourable | Pourable |
| b. 8 weeks/30° C. | " | " |
| c. 4 weeks/40° C. | " | " |
| d. 8 weeks/40° C. | " | Pourable (but thickening) |

Analysis of the data provided in Table 6 indicates that the suspensions of the current invention are chemically, physically and rheologically stable. Additionally, the chemical stability and physical stability of the suspension of the current invention (Suspension 8B) are equal, or substantially equal, to those of Suspension 8A while Suspension 8B has the advantage of rheological superiority and stability.

EXAMPLE 9

The bleaching effectiveness of aqueous peroxyacid suspensions comprising polyethylene glycol was investigated using test suspensions 13 through 16. The compositions of the test suspensions are described in Table 2. In Table 7, %=wt. %.

By measuring the reflectance of stained fabric treated with the various suspensions, the bleaching effectiveness of these suspensions can be demonstrated. The results of the reflectance measurements are provided in Table 7.

For each stain in Table 7, four 6×6 cm swatches were prepared. Each swatch was then wetted with 1 gram of a test suspension so that each suspension was separately tested on each stain. The wetted swatches were stored for 30 minutes then rinsed and dried. The reflectance of each dried swatch was measured by a Minolta Chroma-meter CR-110. The results are contained in Table 7.

TABLE 7

Bleaching Effectiveness of Peroxy Acid Suspensions Containing PEG

| | 13 | 14 | 15 | 16 |
|---|---|---|---|---|
| Test Suspension | | | | |
| DPDA | 25.5% | 23.0% | 21.7% | 20.4% |
| PEG-4 | — | 10% | 15% | 20% |
| Xanthan Gum | 0.2% | 0.2% | 0.2% | 0.2% |
| Hydroxyethylcellulose | 0.2% | 0.2% | 0.2% | 0.2% |
| $Na_2SO_4$ | 3.0% | 2.7% | 2.6% | 2.7% |
| Water | Balance | Balance | Balance | Balance |
| pH | 3.9% | 3.7% | 4.1% | 4.2% |
| Reflectance | | | | |
| Tea Stain | 47 | 53 | 57 | 59 |
| Red Wine Stain | 59 | 69 | 70 | 70 |
| Berry Stain | 57 | 62 | 61 | 64 |

EXAMPLE 10

This example demonstrates that the addition of PEG to peroxy acid suspensions reduces the likelihood of explosion and/or combustion and, consequently, allows storage and transportation of larger volumes of peroxy acids and/or more concentrated suspensions of such acids.

The Pressure Vessel Test ("PVT") is a standard test for determining the quantity of peroxy acid which may be transported in one container. The PVT is described in detail in Vervoer Gevaarlijke stoffen, Dec. 23, 1980, Aanhangsel Al bij bijlage A, pp. 907, 908, 915: Staatsuitgeverij. In sum, the test employs a pressure vessel fitted with a bursting disk set to 6 bar. A side wall of the vessel is fitted with a variable diameter blow-off opening. In operation, 10 grammes of the material to be tested (in this case, peroxy acid suspension described in Table 8) are placed in the pressure vessel. The vessel is then heated with a standardized gas flame. If the bursting disk remains intact, another 10 grammes of test material are charged to the pressure vessel, the size of the blow-off opening is reduced, and the heating is repeated. This process is followed until the bursting disk is just intact, that is, until the next reduction in the blow-off opening would cause rupture of the bursting disk. Naturally, the smaller the acceptable blow-off opening, the safer the formulation. The acceptable blow-off opening (in mm) is the PVT value. For example, a low PVT value will allow single container transportation of at least 450 l of DPDA; and a medium PVT value limits such transport of DPDA to 50 kg.

Table 8 contains the compositions of three peroxy acid suspensions and the results of PVT's on such compositions. In Table 8, %=wt. %.

TABLE 8

Safety of Peroxy Acid Suspensions Containing PEG

| | 17 | 18 | 19 |
|---|---|---|---|
| Test Suspension | | | |
| DPDA | 26.1% | 26.1% | 25.5% |
| PEG-4 | none | none | 15.0% |
| Chelating Agent (Dequest ® 2010) | none | 0.05% | 0.05% |
| Xanthan Gum | 0.2% | 0.2% | 0.2% |
| Hydroxyethylcellulose | 0.2% | 0.2% | 0.2% |
| $Na_2SO_4$ | 3.0% | 3.0% | 1.0% |
| Water | Balance | Balance | Balance |
| Pessure Vessel Test Results | | | |
| Blow-off Opening Diameter (mm) | | | |
| 1 | — | N/T | N/T |
| 1.5 | N/T | N/T | + |
| 2 | — | N/T | — |
| 3 | — | + | N/T |
| 5 | N/T | + | N/T |
| 7 | N/T | — | N/T |
| Safety Risk | Low | Medium | Low |

In Table 8, "—" indicates that the bursting disk did not rupture, a "+" indicates that a rupture occurred and "N/T" indicates no test.

As can be seen from Table 8, the addition of the chelating agent Dequest ® 2010 may substantially increase the potential safety hazard of peroxy acid suspensions. Such chelating agents are usually necessary to remove metallic ions and thus enhance the storage stability of peroxy acid suspensions. However, surprisingly, the addition of PEG to such suspensions reduces the safety hazard of such suspensions to a point that bulk transport to the suspension may be substantially increased.

EXAMPLE 11

This Example shows the applicability of the aqueous peroxide compositions of the present invention in pourable aqueous bleaching compositions according to EP 347 988.

Prepared were suspensions 10a, 10b and 10c having the following compositions:

| | |
|---|---|
| DPDA | 25 wt. % |
| TEG | 10 wt. % |
| $Na_2SO_4$ | 1 wt. % |
| hydroxy ethyl cellulose | 0.2 wt. % |
| Dequest ® 2010 | 0.5 wt. % |
| natural gum | 0.2 wt. % |
| initial pH | 3.5 |

In suspension 10a the natural gum is Xanthan gum, in 10b it is Alpha-flo ® (trademark of Ibis corporation) and in 10c it is Welan gum, a type of gum commercialized by Kelco.

The suspensions were stored at 40° C. for 8 weeks and at room temperature for 26 weeks. They remained single phase during the whole of the two storage periods and showed the required stability. For these suspensions the following data can be given:

| suspension: | 10a | 10b | 10c |
|---|---|---|---|
| active oxygen (%) | 2.95 | 2.85 | 2.87 |
| $H_2O_2$ (%) | 0.32 | 0.33 | 0.34 |
| pH | | | |
| (26 wk. amb.) | 3.0 | 3.2 | 3.1 |
| (8 wk. 40° C.) | 3.0 | 3.0 | 3.0 |
| DPDA-residu (%) | | | |
| (26 wk. amb.) | 97 | 93 | 96 |
| (8 wk. 40° C.) | 82 | 80 | 81 |

EXAMPLE 12

200 gram samples of two DPDA suspensions were prepared using gum arabic in accordance with the procedure of Example 2. The suspensions comprised 25 weight percent of DPDA and 1 or 3 weight percent gum arabic in place of xanthan gum in the same compositions as given in Example 2. As DPDA raw material was employed a filter cake having an active oxygen content of 41.4% and Gummi Arabicum, DAB g/Ph. Eur, From Caelo. The consistency of the suspensions was characterized as easy to pour. The phase stability time was greater than 16 weeks for both suspensions when stored at ambient temperature and greater than 8 weeks for both suspensions when stored at 40° C.

The foregoing examples are presented for the purpose of illustration and description only and are not to be construed as limiting the invention in any way. The scope of the invention is to be determined from the claims appended hereto.

What is claimed is:

1. A pourable bleaching composition comprising a solid, substantially water-insoluble organic peroxyacid stably suspended in an aqueous medium, said aqueous medium comprising from about 0.1 to about 1% by weight of the bleaching composition of a first polymer selected from the group consisting of polysaccharides having at least 60% of the units in the polysaccharide backbone linked together by a 1,4-$\beta$-oxy linkage and from about 0.02 to about 2% by weight of the bleaching composition of a second selected from the group consisting of polyvinyl alcohol, one or more cellulose derivatives and mixtures thereof, said first and second polymers being present in amounts effective to provide a physically and chemically stable, pourable bleaching composition.

2. A composition according to claim 1 wherein said first polymer is selected from the group consisting of natural or synthetic gums.

3. A composition according to claim 2 wherein said second polymer is selected from the group consisting of cellulose ethers and mixtures thereof.

4. A composition according to claim 3 wherein said second polymer is selected from the group consisting of methyl cellulose, methyl hydroxypropyl cellulose, methyl hydroxybutyl cellulose, hydroxyethyl cellulose and carboxymethyl cellulose.

5. A composition according to claim 1 wherein said organic peroxy acid further comprises a water-impermeable material.

6. A composition according to claim 5 wherein said water-impermeable material is selected from the group consisting of lauric acid, myristric acid and a mixture thereof.

7. A composition according to claim 1 which further comprises up to about 30% by weight of an electrolyte.

8. A composition according to claim 7 wherein said electrolyte is sodium sulfate.

9. A composition according to claim 3 wherein said organic peroxy acid is selected from the group consisting of diperoxyacids.

10. A composition according to claim 9, wherein the diperoxy acid is 1,12-diperoxydodecanedioic acid.

11. A composition according to claim 3 wherein said organic peroxy acid is selected from the group consisting of peroxyacids having a polar amide link.

12. A composition according to claim 3 wherein said organic peroxy acid is selected from the group consisting of alkyl sulphonyl peroxycarboxylic acids.

13. A composition according to claim 3 further comprising an effective amount of a safety booster selected from the group consisting of triethylene glycol, polyethylene glycol and mixtures thereof.

* * * * *

UNITED STATES PATENT AND TRADEMARK OFFICE

CERTIFICATE OF CORRECTION

PATENT NO. : 5,358,654

DATED : October 25, 1994

INVENTOR(S) : TORENBEEK Reinder et al.

It is certified that error appears in the above-identified patent and that said Letters Patent is hereby corrected as shown below:

Column 14, line 13:
In Claim 1, line 10 , the word "polymer" should be inserted after the word "second".

Signed and Sealed this

Twentieth Day of December, 1994

*Attest:*

Bruce Lehman

BRUCE LEHMAN

*Attesting Officer*

*Commissioner of Patents and Trademarks*